United States Patent [19]

Gold

[11] Patent Number: 4,757,555

[45] Date of Patent: Jul. 19, 1988

[54] SKI RACING GLOVE

[76] Inventor: Danny Gold, 23 Repulse Bay Rd., Apt. 4B, Hong Kong, Hong Kong

[21] Appl. No.: 77,837

[22] Filed: Jul. 27, 1987

[51] Int. Cl.[4] ..... A41D 19/01

[52] U.S. Cl. ..... 2/16; 2/161 A

[58] Field of Search ..... 2/16, 17, 158, 159, 2/161 R, 161 A, 164

[56] References Cited

U.S. PATENT DOCUMENTS

| | | | |
|---|---|---|---|
| 1,796,319 | 3/1931 | Burden | 2/161 R |
| 3,741,207 | 6/1973 | Fuson | 2/16 X |
| 3,911,497 | 10/1975 | Lewis et al. | 2/16 |
| 3,918,096 | 11/1975 | Lim | 2/161 A |
| 4,042,975 | 8/1977 | Elliott, Jr. et al. | 2/19 |
| 4,051,553 | 10/1977 | Howard | 2/161 A |
| 4,067,063 | 1/1978 | Ettinger | 2/2 |
| 4,137,572 | 2/1979 | Jansson et al. | 2/16 |
| 4,411,024 | 10/1983 | Hayes | 2/161 A |
| 4,484,359 | 11/1984 | Tirinen | 2/20 |
| 4,485,917 | 12/1984 | Smith | 206/278 |
| 4,488,313 | 12/1984 | Delaney | 2/17 |
| 4,570,269 | 2/1986 | Berlese | 2/161 A |
| 4,572,545 | 2/1986 | Dooley et al. | 2/16 |

FOREIGN PATENT DOCUMENTS

| | | | |
|---|---|---|---|
| 3151852 | 7/1983 | Fed. Rep. of Germany | 2/16 |

*Primary Examiner*—Louis K. Rimrodt

*Attorney, Agent, or Firm*—Paul S. Aufrichtig

[57] ABSTRACT

A protective garment for protecting at least a wearer's hand. The protective garment can also protect the wearer's wrist and forearm or other body parts. An inner covering member covers a wearer's hand and has a first inner surface for contacting the weaer's hand and a first outer surface. An outer covering member has a second inner surface and second outer surface. The portion of the second inner surface is coupled to a portion of the first outer surface and forms a closed pocket region therebetween. A protective layer is contained and freely displaceable within the closed pocket region for protecting the wearer's hand from injury and displacing to provide flexibility to the protective garment.

25 Claims, 2 Drawing Sheets

FIG. 3
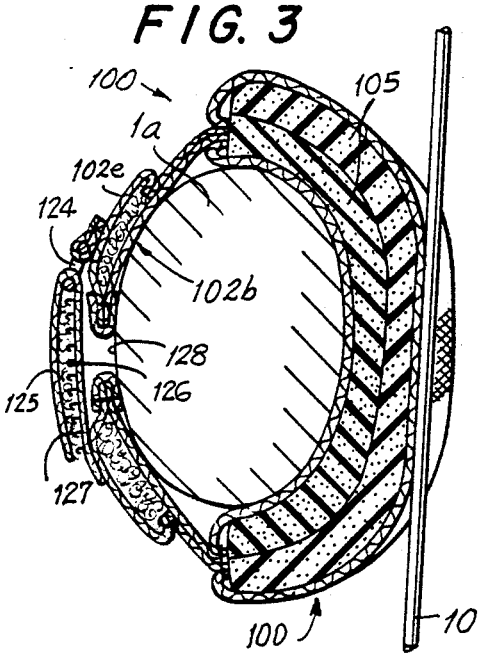
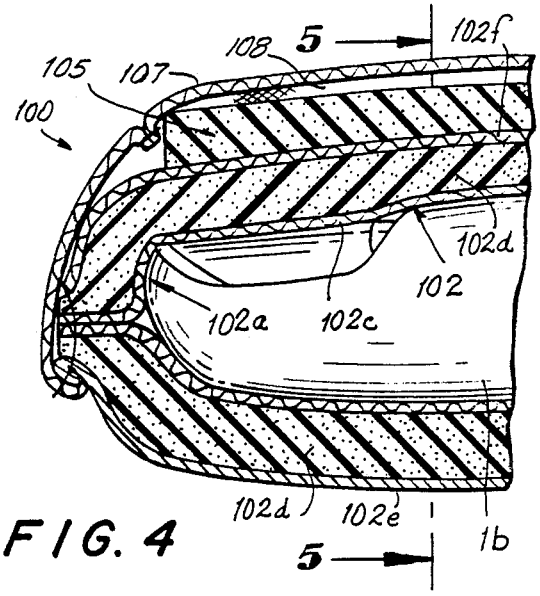
FIG. 4
FIG. 5
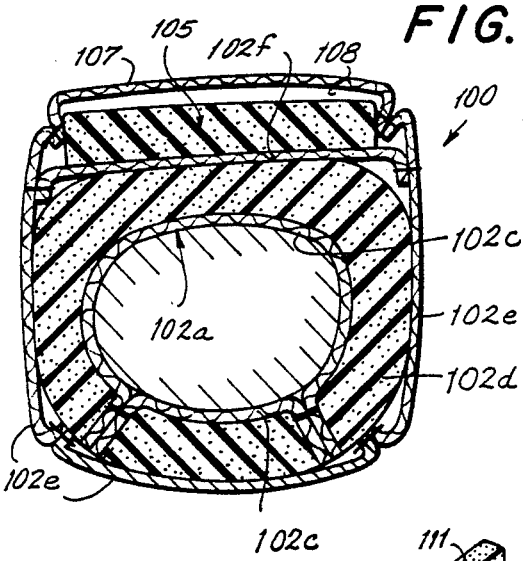
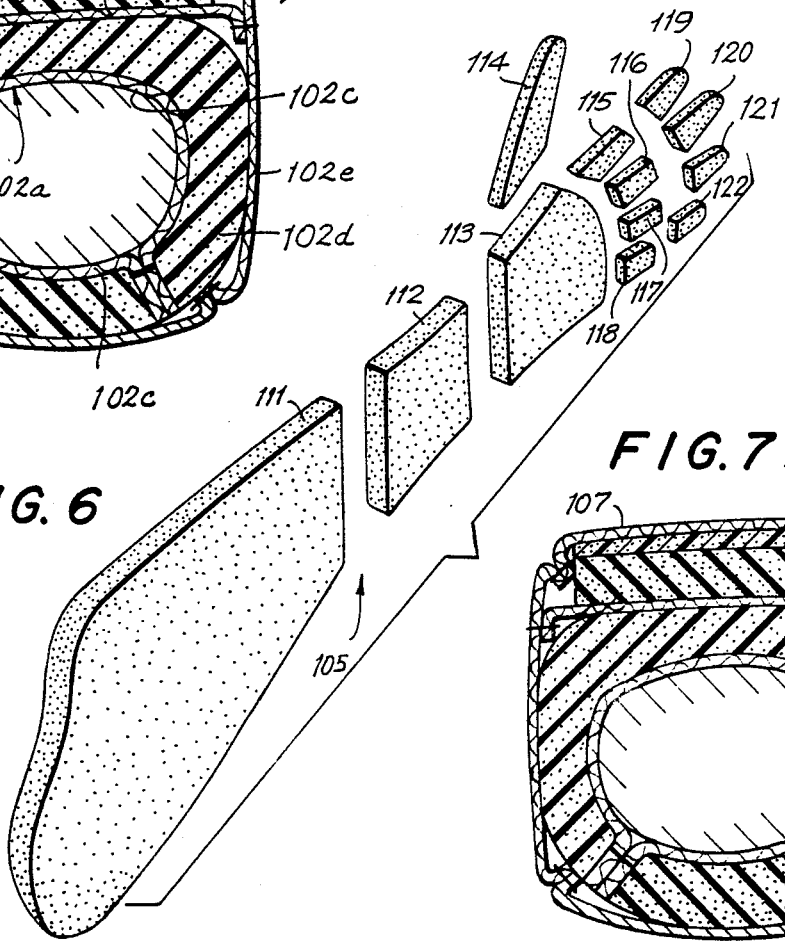
FIG. 6
FIG. 7
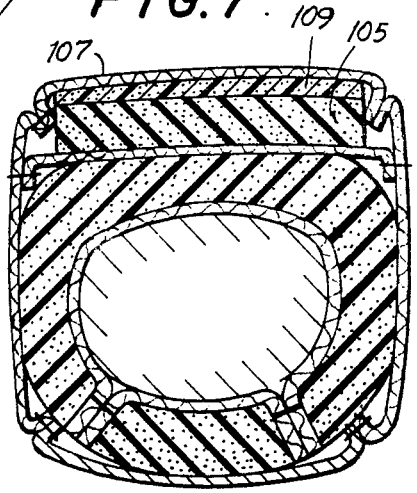

SKI RACING GLOVE

BACKGROUND OF THE INVENTION

The invention is generally directed to a protective garment for protecting at least the wearer's hand and in particular to a glove for protecting at least the wearer's hand from injury while providing significant flexibility.

A variety of pursuits such as ski racing subject the hand and lower arm of a wearer to violent contact with a hard object. For example, in ski racing the racer navigates a course between a series of upright posts or gates. To minimize the path travelled and thus the time for running a race course skiers take a path which is as close to the gates with their skis as possible. An accepted technique for skiing gates is to swing the inside arm against the vertical pole of a gate while skiing past the gate to provide the shortest path around the gate and prepare for the next turn. This has the effect of causing the skier's hand and/or lower arm to repeatedly bang into the gates as the skier covers the course. The forces involved can be rather dangerous as the skier reaches high speeds of between 30 and 70 m.p.h. depending upon whether the race is a slalom, giant slalom or downhill type race.

As a result, there is a need for protection on the hand and lower arm of a ski racer. There are ski racing gloves available which utilize padding of different types where the padding is affixed to the glove at the location where padding is needed. However, this fixed padding tends to seriously restrict the flexibility of the wearer's fingers, hand and wrist which are essential in sporting endeavors such as ski racing. In addition, this padding presents a bumpy exterior which is more likely to catch on a gate or other obstruction and which provides increased wind resistance.

There are protective gloves which utilize discrete protective padding fixed in place, but separated to allow flexibility. However, this type of protective device sacrifices protection in the knuckle area in favor of flexibility.

Accordingly, there is a need for a protective glove which protects the wearer's hand or hand and lower arm from injury and pain from violent contact while providing for significant flexibility of the hands and wrist.

SUMMARY OF THE INVENTION

The invention is generally directed to a protective garment for protecting at least the wearer's hand. An inner covering member covers a wearer's hand and has a first inner surface for contacting the wearer's hand and a first outer surface. An outer covering member has a second inner surface and a second outer surface. A portion of the outer covering member is coupled to a portion of the first outer surface of the inner covering member and the second inner surface of the outer covering member thereby forming a closed pocket region therebetween. A protective member or members is contained and freely displacable within the closed pocket region for protecting the wearer's hand from injury and providing flexibility to the protective garment.

Accordingly, it is an object of the invention to provide an improved protective garment for protecting at least the wearer's hand.

Another object of the invention is to provide an improved protective garment for protecting a wearer's hand and lower arm from pain and injury while providing sufficient flexibility for easy movement of the wearer's hand and wrist.

A further object of the invention is to provide an improved ski racing glove which provides protection against injury and pain while providing needed flexibility.

Yet another object of the invention is to provide an improved protective garment for protecting a wearer's hand, providing flexibility and presenting a smooth exterior to reduce frictional engagement and wind resistance.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 3 is a cross sectional view taken along line 3—3 of FIG. 1;

FIG. 4 is a cross sectional view taken along line 4—4 of FIG. 1;

FIG. 5 is a cross sectional view taken along 5—5 of FIG. 4;

FIG. 6 is a perspective view of a protective member used in a protective glove in accordance with a third embodiment of the invention; and FIG. 7 is a cross sectional view similar to FIG. 5 with another protective member in accordance with the invention.

DETAILED DESCRIPTION OF THE PREFERRED EMBODIMENTS

Figure 1:
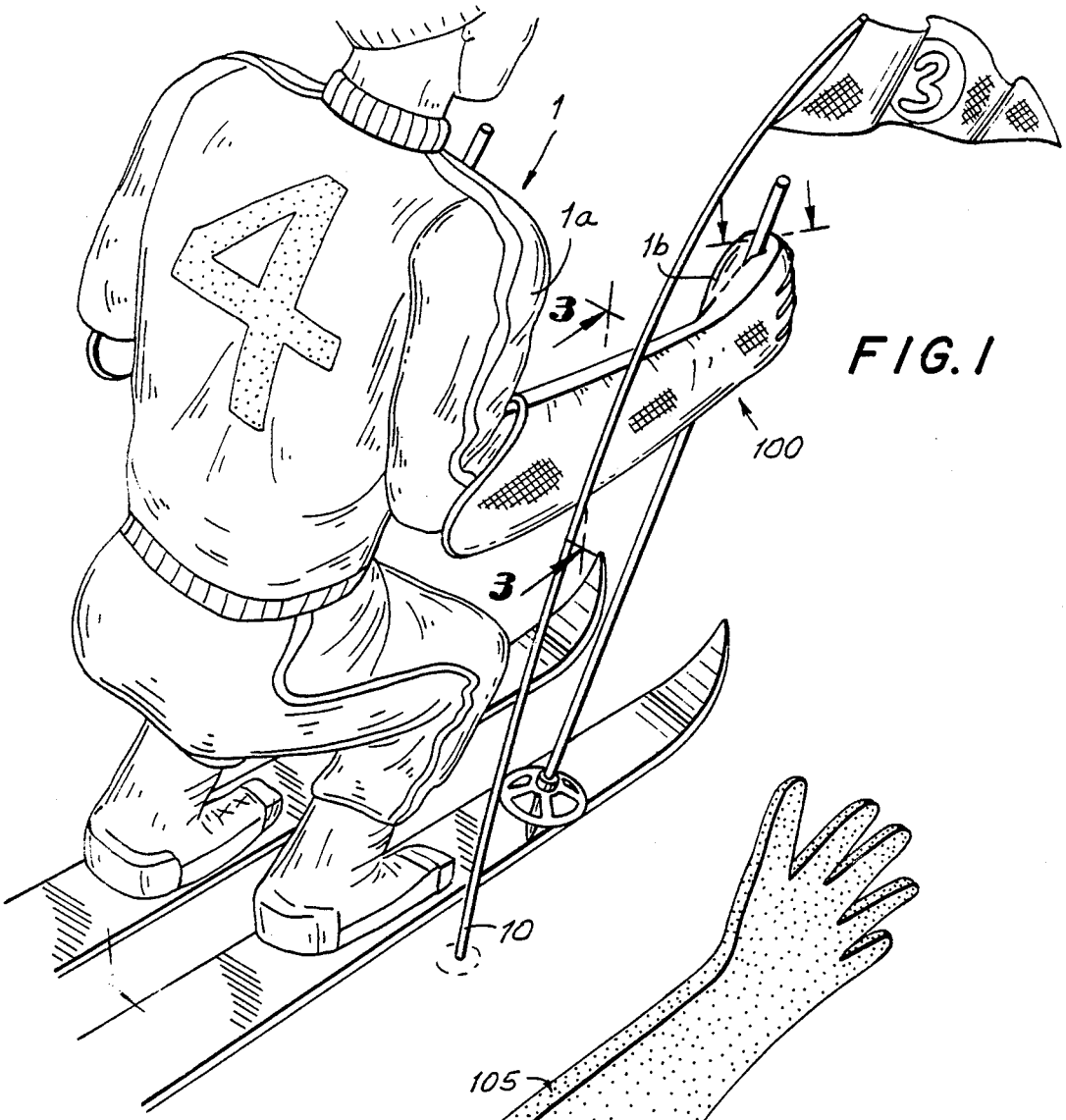
FIG. 1 is a perspective view of a skier wearing a protective glove in accordance with the invention.

Reference is made to FIG. 1 wherein a skier wearing a glove, generally indicated as 100 constructed in accordance with the invention is depicted. As seen, skier 1, in navagating gate 10 places skis 2 as close as possible to gate 10 to minimize the distance around gate 10. This has the effect, as shown in FIG. 1 and more clearly in FIG. 3, of pressing the skier's arm 1*a* against gate 10. In fact, accepted racing technique has the skier swinging at the pole to hit the pole with his clenched fist. As seen in FIGS. 1 and 3, glove 100 has a protective padding layer 105 which deforms to absorb and distribute the force created by the often violent slamming of the skier's arm 1*a* against gate 10. The padding 105 is on the outside surface of the skier's hand 1*b* and fore arm 1*a* because the violent contact with a gate 10 or the ground in a sideways fall would be on this surface. The inner surface of protective glove 100 does not contain a similar thick protective layer 105 although such a protective layer may be appropriate in a different situation.

Reference is next made to FIGS. 2, 3, 4 and 5 for a description of the manner in which protective glove 100 is constructed. Protective glove 100 is shown as covering the hand and entire lower arm of the skier in FIG. 1. However, a glove covering the wearer's hand and only a portion of the lower arm or even just the wearer's hand may be provided in accordance with the invention.

Glove 100 is formed of an inner glove layer 102 which includes finger sections 102*a* and hand and arm covering portion 102*b*. Inner glove layer 102*a* includes an interior, skin contacting surface 102*c* which can be made of a soft natural or synthetic fabric. Skin contacting surface 102*c* is coupled to an insulating and protective layer 102*d* which itself is surrounded by an inner shell layer 102*e* on three sides and a dividing layer 102*f* on the fourth outer surface. Layer 102*d* can be easily made of a soft open pore foam. In some situations layer 102*d* can be completely eliminated. Shell layer 102*e* can be formed of various sturdy natural and synthetic materials such as leather, particularly for the surface covering the inner portion of the fingers and palm, nylon and other natural and synthetic materials. In a preferred embodiment separating layer 102*f* is formed of a stretchy material to increase flexibility. However, separating layer 102*f* may also be formed of a material similar to inner shell layer 102*e* or other material.

An outer shell 107 is attached at its edges to inner shell member 102*e* to form a complete outer shell for glove 100. The complete outer shell presents a smooth surface with all padding on the inside. In addition, outer shell 107 in connection with separating layer 102*f* creates a closed pocket region 108 running along the outside of the fingers, hand and arm portions of glove 100. Outer shell 107 is connected to inner shell member 102*e* and separating layer 102*f* by stitching. Before closed pocket region 108 is sealed by attaching outer shell 107 to inner shell 102*e* and separating layer 102*f*, a protective layer 105 is placed in pocket region 108.

Figure 2:
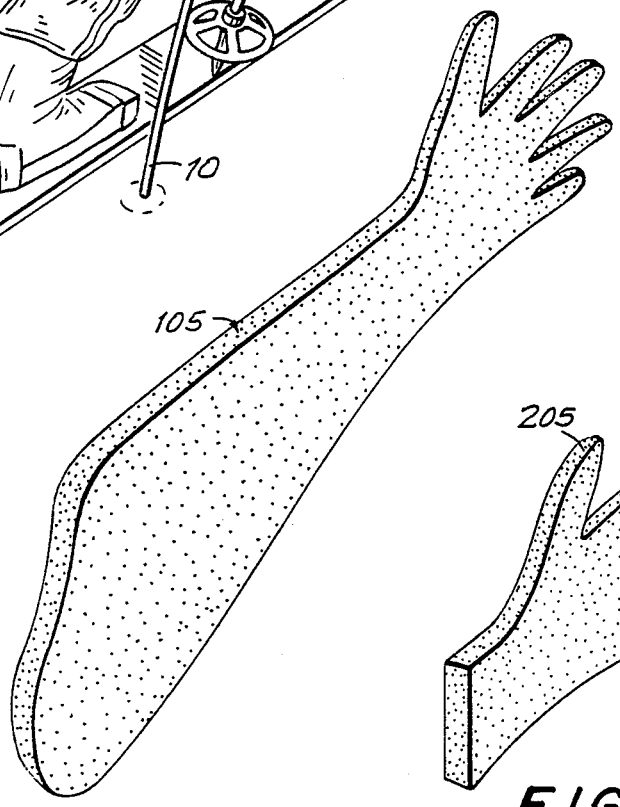
FIG. 2 is a perspective view of a protective insert used in a protective glove in accordance with the invention.

Protective layer 105, as shown in FIG. 2 can be a single layer or may include separate portions as shown in FIG. 6. Closed pocket region 108 is sized so as to allow protective layer 105 to float freely between separating layer 102*f* and outer shell layer 107. In this way the protective layer 105, which in a preferred embodiment is a thick foam layer, does not restrict the flexibility of the user's fingers, hand and wrist. Protective layer 105 can be an open or closed cell foam, such as a polyurethane foam. To improve the protection of the glove without decreasing flexibility or effecting the smoothness of the exterior, composite arrangements of materials may be used for protective layer 105. For example, higher density foam may be used in high impact areas requiring special protection, such as the knuckles. Other approaches include using two or more layers of different foams or other materials to vary the protection provided.

The flexibility of the protective glove is aided by a precurvature of the finger and hand portion. The precurving of the finger portions is exaggerated in the glove as opposed to standard ski gloves which have slight preshaping. As a wearer attempts to make a fist the circumference of the hand naturally increases. Where the padding is fixed in place on the glove, the padding hinders flexibility whereas the floating protective layer freely moves thereby aiding flexibility. The precurvature provides the room needed for the hand and fingers as the circumference of the hand expands when a fist is made. The precurvature of the finger portion also takes into account the extended length necessary in the finger section regions when the fingers are curved inwardly, further minimizing the negative effect on flexibility of protective padding on the outside of the glove.

In a preferred embodiment the inner and outer shells 102*e*, 107 are formed of a woven textile and protective layer 105 is formed of a polyurethane foam. In situations where even more protection is required, protective layer 105 can be supplemented with a rigid layer 109 as shown in FIG. 7 attached to protective layer 105. Protective layer 109 can be formed of fiberboard glued to the stop of foam protective layer 105 as further protection against the rigorous compaction of the glove in a high speed encounter with a spring loaded racing gate. The stiffening of protective layer 105 does not reduce the flexibility of the glove as the two layers still float freely within closed pocket region 108.

In situations where the single piece protective layer 105 shown in FIG. 2 does not provide sufficient flexibility, even freely floating within closed pocket region 108, protective layer 105 may be formed of separate protective members. As shown in FIG. 6, there is a forearm section 111, wrist section 112, hand section 113, thumb section 114, first knuckle sections 115, 116, 117, 118 and upper finger portions 119, 120, 121, 122. The separate sections are shown spaced apart in FIG. 6 but in actual practice would sit against acjacent pieces, while still free to separately float within closed pocket 108 as the wearer moves his fingers, hand or wrist. As a result, protective layer 105 still provides complete protection of the fingers, hand and forearm from jarring impact even though protective layer 105 includes various separate pads. FIG. 6 shows protective layer 105 separated into 12 different sections. However, layer 105 can be divided into a smaller or greater number of protective sections depending on the particular needs.

Where protective layer 105 is separated as shown in FIG. 6, some of the sections may be stitched or otherwise fixed in place. This is appropriate only for those sections which do not restrict the flexibility, such as upper finger portions 119, 120, 121, 122. However, at least some of the sections float freely to provide the flexibility and maintain the outer surfaces smoothness.

Figure 2A:
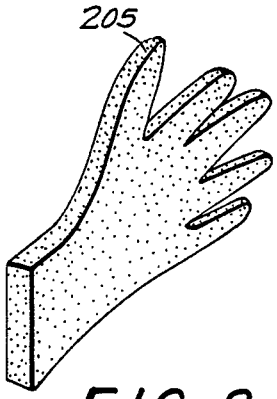
FIG. 2A is a perspective view of a protective insert used in a protective glove constructed in accordance with a second embodiment of the invention.

While glove 100 is shown as covering the hand, fingers and forearm of a wearer, a shorter glove covering only the hand or the hand and wrist or the hand, wrist and a small portion of the forearm can be constructed. As shown in FIG. 2A, a protective layer 205 for protecting only the hand and wrist of a wearer is shown. Such a glove operates in an identical fashion to the longer protective glove 100.

As shown in FIG. 3, the arm portion of glove 100 can be tightened on the wearer's arm by a tightening assembly which includes a metal loop 124 secured with a loop sewn or otherwise affixed to inner shell 102e on one side of an opening 128 which allows for the tightening or loosening of the glove around the wearer's forearm. A strap 125 bearing hook and pile fasteners 126 and 127 has one end coupled to inner shell 102*e* on the other side of opening 128. The free end of strap 125 passes through rectangular buckle 124 and then secures the opening 128 of the glove in a fixed position by selective attachment of hook and pile fasteners 126, 127 to fit the wearer's arm. In a preferred embodiment there are two strap and metal loop assemblies on each glove.

Thus, a ski racer or other user of the protective gloves loosens the strap or straps which are on the inside of the glove, slides his hand all the way into a glove and then tightens the straps in position thereby protecting his hand and arms. The foam protective layer 105 also serves an insulating function acting to keep the wearer's hand and arm warm.

While the protective garment has been described above as for use as a ski racing glove it can also be used by recreational skiers, and for other sports such as hockey, cricket and lacrosse in which the hands and forearms require protection, or in industrial applications where the combination of protection and flexibility are required. Further, the protective garment which provides protection and flexibility by utilizing a protective layer which floats freely within a closed pocket region can be utilized to protect areas around other joints of the body such as the knees, ankles, feet, shoulders or hips of a wearer.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A protective garment for protecting at least a wearer's hand, comprising:

inner covering means for covering a wearer's hand having a first inner surface for contacting the wearer's hand and a first outer surface;

outer covering means having a second inner surface and a second outer surface, a portion of the second inner surface being coupled to a portion of the first outer surface of the inner covering means and forming a closed pocket region therebetween; and protective means contained and freely displaceable within the closed pocket region for protecting the wearer's hand from injury and displacing to provide flexibility to the protective garment.

2. The protective garment of claim 1 wherein the inner covering means includes a glove covering the wearer's hand and wrist.

3. The protective garment of claim 2 wherein the protective means includes a padding layer which floats freely in a closed pocket region as the wearer's hand is flexed and whereby the flexibility of the protective garment is maintained while providing protection to the wearer's hand.

4. The protective garment of claim 2 wherein the protective means includes at least two padding members each of which is capable of freely floating within the closed pocket region as the wearer's hand is flexed, whereby the flexibility of the protective garment is maintained while providing protection to the wearer's hand.

5. The protective garment of claim 1 wherein the inner covering means includes a glove covering the wearer's hand, wrist and forearm.

6. The protective garment of claim 5 wherein the protective means includes a padding layer which floats freely in the closed pocket region as the wearer's hand is flexed and whereby the flexibility of the protective garment is maintained while providing protection to the wearer's hand.

7. The protective garment of claim 5 wherein the protective means includes at least two padding members each of which is capable of freely floating within the closed pocket region as the wearer's hand is flexed, whereby the flexibility of the protective garment is maintained while providing protection to the wearer's hand.

8. The protective garment of claim 1 wherein the inner covering means include finger sections for covering the wearer's fingers.

9. The protective garment of claim 8 wherein the finger sections are significantly precurved to provide additional flexibility.

10. The protective garment of claim 1 wherein the first outer surface of the inner covering means and the second outer surface of the outer covering means form a shell of the protective garment.

11. The protective garment of claim 6 wherein the shell is formed of a woven textile and the protective means is formed of a tricot laminated foam.

12. The protective garment of claim 1 wherein the protective means includes a padding layer which floats freely in the closed pocket region as the wearer's hand is flexed and whereby the flexibility of the protective garment is maintained while providing protection to the wearer's hand.

13. The protective garment of claim 12 wherein the padding layer has a stiff layer mechanically attached thereto for proving additional protection.

14. The protective garment of claim 1 wherein the protective means includes at least two padding members each of which is capable of freely floating within the closed pocket region as the wearer's hand is flexed, whereby the flexibility of the protective garment is maintained while providing protection to the wearer's hand.

15. The protective garment of claim 14 wherein at least one of the padding members further includes a stiffening member mechanically coupled thereto for providing additional protection.

16. The protective garment of claim 1 further comprising fastening means for securing the protective garment in place.

17. The protective garment of claim 16 wherein the fastening means includes a strap with hook and pile fasteners and a loop, both of which are coupled to the second outer surface for tightening the protective garment in place.

18. A protective garment for protecting a wearer's body at or around a joint, comprising:

inner covering means for covering a wearer's joint and surrounding body area having a first inner surface for contacting the wearer's body and a first outer surface;

outer covering means having a second inner surface and a second outer surface, a portion of the second inner surface being coupled to a portion of the first outer surface of the inner covering means and forming a closed pocket region therebetween; and protective means contained and freely displaceable within the closed pocket region for protecting the wearer's joint and surrounding body area from injury and displacing to provide flexibility of the protective garment.

19. The protective garment of claim 18 wherein the protective means include a padding layer which floats freely within the closed pocket region to protect the wearer's joint and surrounding body.

20. The protective garment of claim 18 wherein the protective means include a padding layer formed of at least two separate members which float freely within the closed pocket region to protect the wearer's joint and surrounding body.

21. A protective garment for protecting at least a wearer's hand, comprising:

inner covering means for covering a wearer's hand having a first inner surface for contacting the wearer's hand and a first outer surface;

outer covering means having a second inner surface and a second outer surface, a portion of the second inner surface being coupled to a portion of the first outer surface of the inner covering means and forming a closed pocket region therebetween; and protective means contained within the closed pocket region at least a portion of the protective means being freely displaceable within the claimed pocket region for protecting the wearer's hand from injury and displacing to provide flexibility to the protective garment.

22. The protective garment of claim 21 wherein the protective means includes at least two sections.

23. The protective garment of claim 22 wherein one of the sections is fixed in placed inside the closed pocket region.

24. A ski racing glove for protecting at least wearer's hand, comprising:

inner covering means for covering the wearer's hand having a first inner surface for contacting the wearer's hand and a first outer surface;

outer covering means having a second inner surface and a second outer surface, a portion of the second inner surface being coupled to a portion of the first outer surface of the inner covering means and forming a closed pocket region therebetween; and protective means contained within the closed pocket region for protecting the wearer's hand from injury and displacing to provide flexibility to the protective garment, the second outer surface of the outer covering means having a smooth shape, whereby frictional engagement and wind resistance are reduced.

25. The ski racing glove of claim 24 wherein the protective means is freely displaceable within the closed pocket region to protect the wearer's hand from injury and displacing to provide flexibility to the ski racing glove.

* * * * *